US011059146B2

(12) United States Patent
Busskamp

(10) Patent No.: US 11,059,146 B2
(45) Date of Patent: Jul. 13, 2021

(54) METHOD FOR SHOT PEENING A PIPE INNER WALL OF A CURVED WORKPIECE HAVING A WORKPIECE BORE, AND BLASTING NOZZLE UNIT AND BLASTING CHAMBER SYSTEM THEREFOR

(71) Applicant: WHEELABRATOR GROUP GMBH, Metelen (DE)

(72) Inventor: Bernhard Busskamp, Emsdetten (DE)

(73) Assignee: WHEELABRATOR GROUP GmbH, Metelen (DE)

( * ) Notice: Subject to any disclaimer, the term of this patent is extended or adjusted under 35 U.S.C. 154(b) by 884 days.

(21) Appl. No.: 15/119,237

(22) PCT Filed: Feb. 19, 2015

(86) PCT No.: PCT/DE2015/100068
§ 371 (c)(1),
(2) Date: Aug. 16, 2016

(87) PCT Pub. No.: WO2015/124147
PCT Pub. Date: Aug. 27, 2015

(65) Prior Publication Data

US 2017/0008151 A1 Jan. 12, 2017

(30) Foreign Application Priority Data

Feb. 19, 2014 (DE) ..... 10 2014 102 147.9

(51) Int. Cl.
*B24C 3/32* (2006.01)
*B24C 1/10* (2006.01)

(52) U.S. Cl.
CPC ..... *B24C 3/325* (2013.01); *B24C 1/10* (2013.01)

(58) Field of Classification Search
CPC ..... B24C 3/325; B24C 1/10; B23K 9/048; B21D 39/06; B21D 31/06; C21D 7/06; B05B 7/0075; B05B 7/12; B05B 7/14
(Continued)

(56) References Cited

U.S. PATENT DOCUMENTS 4,713,882 A * 12/1987 Bianchi ..... B21D 39/06 29/726
4,893,490 A 1/1990 Isnardon et al.
(Continued)

FOREIGN PATENT DOCUMENTS

CN 1986161 A 6/2007
DE 102011005762 A1 9/2012

*Primary Examiner* — Adam J Eiseman
*Assistant Examiner* — Bobby Yeonjin Kim
(74) *Attorney, Agent, or Firm* — Muncy, Geissler, Olds & Lowe, P.C.

(57) ABSTRACT

For the shot peening of a pipe inner wall of a curved workpiece (200) having a workpiece bore (201), use is made of a flexible blasting abrasive feed hose (10) having blasting nozzle head (20). The latter is guided through a supporting element (30) which is applied to one workpiece end (203). The blasting abrasive feed hose (10) together with the blasting nozzle head (20) is introduced into the workpiece bore (201) and advanced along a blasting treatment section therein, and subsequently retracted into the supporting element (30) again. The blasting abrasive is emitted during the advancing movement and/or during the retraction movement. A blasting nozzle unit (100) suitable for carrying out the method comprises a flexible blasting abrasive feed hose (10) and a blasting nozzle head (20) connected to the blasting abrasive feed hose (10). The blasting nozzle head (20) has a plurality of nozzle openings (21) distributed around the circumference. The outer circumference of the blasting nozzle head (21) is smaller than the inside diameter of the workpiece bore (201) in a workpiece (200) to be
(Continued)

processed. The blasting abrasive feed hose (10) is guided in a supporting element (30) and this element (30) is guided in a displaceable manner in a stationary bearing element (40).

11 Claims, 5 Drawing Sheets

(58) Field of Classification Search
USPC ..... 72/53; 239/416.4, 416.5, 423, 424, 433
See application file for complete search history.

(56) References Cited

U.S. PATENT DOCUMENTS 5,307,661 A * 5/1994 Fink ..... B24C 3/325
376/249
5,443,201 A * 8/1995 Cartry ..... B23K 9/048
228/119
5,797,290 A * 8/1998 Blissell ..... B24C 1/10
29/727
2017/0008151 A1* 1/2017 Busskamp ..... B24C 3/325

* cited by examiner

METHOD FOR SHOT PEENING A PIPE INNER WALL OF A CURVED WORKPIECE HAVING A WORKPIECE BORE, AND BLASTING NOZZLE UNIT AND BLASTING CHAMBER SYSTEM THEREFOR

BACKGROUND OF THE INVENTION

The invention relates to a method for shot-peening an inner pipe wall of a curved workpiece with a workpiece borehole for carrying out the method.

By selecting pipes in place of solid bars, mass can be saved in dynamically accelerated systems. The hardening of the surfaces by means of shot-peening results in a significant increase in the carrying capacity compared to untreated pipes, in particular in case of vibration stress. The impact of the blast particles, which are especially small spherical elements, leads to the hardening of the surfaces and to a reduction in the susceptibility to stress cracking.

A method for shot blasting of pipes, and a blasting nozzle unit therefor, are known from the DE 35 27 923 A1. This treatment method has proven itself in principle. However, it is problematic that the blasting nozzle head sends out the blasting agent in one direction only. It must, therefore, constantly be rotated to achieve a uniform hardening of the surface around the inner circumference. The feed must be coordinated with the rotation to properly blast the entire surface.

Known from DE 199 22 265 B4 is another blasting nozzle that can rotate around its longitudinal axis. It is guided through a cover which covers the clear annular gap between the blasting nozzle and a pipe with a correspondingly larger diameter.

Certain workpieces have curves, as, for example, stabilizer pipes for the chassis of road and rail vehicles, or aircraft. A three-dimensional curved progression of the pipe is often necessary to bypass adjacent components and to be able to place the pipe at all in tight spaces.

In the shot-peening treatment of pipes that already have a small pipe diameter, i.e., of a maximum of 1 inch, and that include even stronger curvatures which extend over an arc of more than about 10°-20° and/or for which the radius of curvature is relatively small, especially less than ten times the inner pipe diameter, it is difficult to effect a uniform treatment of the entire inner surface. The orientation of the nozzle opening when blasting can no longer be tracked securely from the outside, because, for example, the blasting agent feed hose that has the blasting nozzle arranged at its end, is twisted. It is thus possible that the nozzle blasts only linearly into a limited circumferential area.

If the known blasting nozzle unit is inserted in such an area of curvature with narrow pipe boreholes, there is the additional risk that it gets stuck there and acts only at one point. The nozzle unit may even no longer be pushed through the entire range of curvatures.

JP 2012-179 696 A discloses a blasting nozzle with a flexible hose positioned in front of the nozzle with the nozzle openings, when viewed in the feed direction of the blasting agent.

Known according to DE 10 201 1 005 762 A1 is a blasting chamber with two doors that serve alternatively to close the chamber. Devices for receiving workpieces are provided at the inner door.

SUMMARY OF THE INVENTION

The problem addressed by the present invention is therefore to improve a method and a blasting nozzle unit of the aforementioned kind such that curved regions of a pipe with small diameters can be blasted uniformly with blasting particles from the inside.

This objective, as well as other objectives which will become apparent from the discussion that follows, are achieved, according to the present invention, by a method and apparatus in which:

a) at least one end region of the blasting agent supply hose adjacent to the blasting nozzle head is guided through a support element;

b) the support element and the workpiece end are placed in contact with each other;

c) the blasting agent supply hose with the blasting nozzle head is inserted into the workpiece borehole and pushed forward along a blasting treatment path inside the workpiece borehole and thereafter is again retracted into the support element, whereby the blasting agent is released through the nozzle openings during the forward movement and/or during the retraction movement; and d) the support element is retracted from the workpiece end or the workpiece end is retracted from the support element.

According to the invention, the blasting agent supply hose at its end that faces away from the blasting nozzle head is connected to a rigid blasting agent supply pipe. The unit comprising the blasting agent supply hose and blasting agent supply pipe is then guided slidably inside the support element.

The blasting nozzle head is guided in the workpiece by a borehole or by an otherwise shaped channel located on the inside. It does not have to have a circular shape. The internal diameter of the inner circle is relatively small such that it cannot be treated by shot-peening using conventional methods and devices. On the other hand, it is large enough to receive a small blasting head. In addition, a certain air gap width must be present between the blasting head and the inner wall such that the blasting agent can exit and be directed at a sufficiently high speed onto the wall to achieve the desired hardening effect. According to the invention, a shot-peening treatment is made possible with an inside diameter of the workpiece borehole of one inch (approx. 25 mm) and less. With the method according to the invention, the smallest inside diameter to be treated is around 12 mm to 16 mm.

To counter the risk of jamming, a relatively short blasting nozzle head is intended to be used in order to overcome even narrow curve radii. For an inner diameter of a pipe bend of 16 mm, for example, a blasting nozzle head with a length of only about 12 mm is provided.

Although a hydraulic, pneumatic or motorized drive for the support element is possible, it is advantageous to provide a feeder unit between the support element and the bearing element that is simply formed by a spring, in particular a compression spring. The workpiece is then guided to the end of the support element and moves the same slightly back in relation to the bearing element. This also tensions the spring and creates a constant pressing force. After removing the workpiece, the spring pushes the support tube back into the original position.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
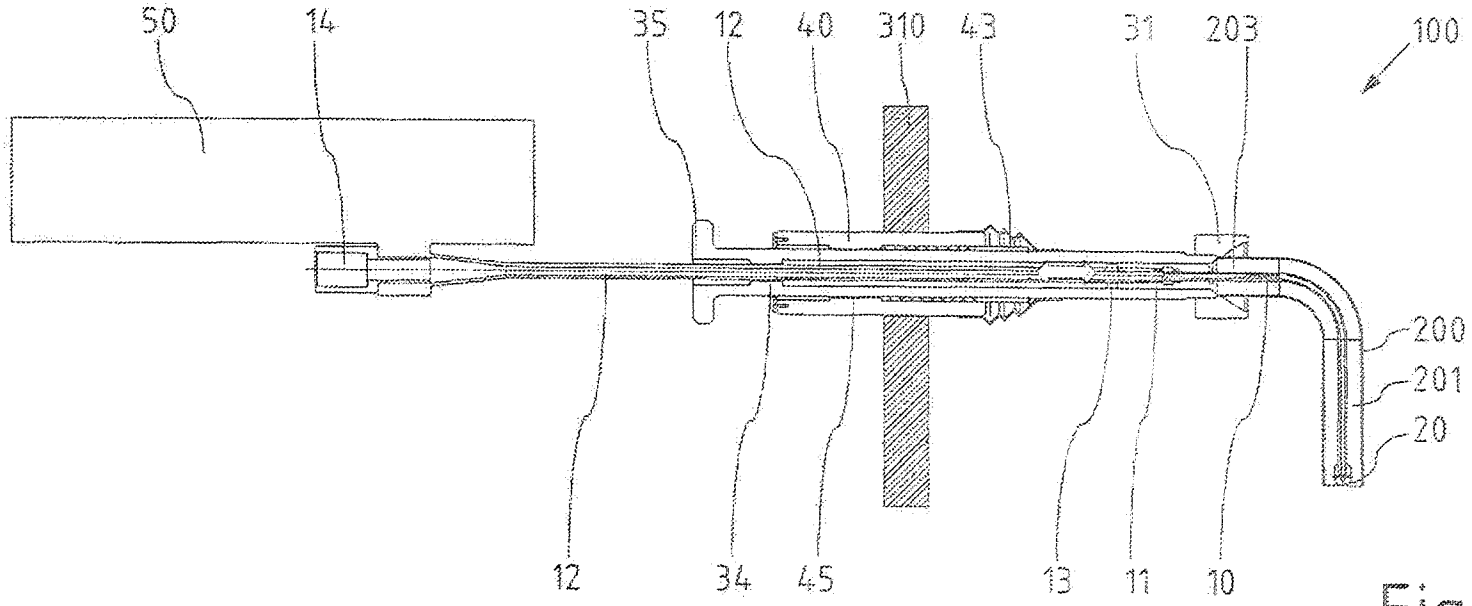
FIG. 1 shows a section of a blasting nozzle unit according to the present invention, in the operating position.

The preferred embodiments of the present invention will now be described with reference to FIGS. 1-5 of the drawings. Identical elements in the various figures are designated with the same reference numerals.

FIG. 1 shows on the right side a workpiece 200 such as a stabilizer element of a motor vehicle chassis, for example, in the region of a curvature 202. It has at least one inner borehole 201. Presented next to it in FIG. 1 is a blasting nozzle unit 100 in sectional view comprising the following essential assemblies:

A flexible blasting agent supply hose 10 with a blasting nozzle head 20:

A support element 30 in which the blasting agent supply hose 10 is guided;

A stationary bearing element 40, in which the support element 30 is guided slideably;

A feed unit for placing the support element 30 onto the end 203 of the workpiece 200 to be treated as well as A traveling unit 50 to move the blasting agent supply hose 10 and the blasting nozzle head 20 relative to the workpiece 200 to be treated.

In the presented embodiment, the blasting agent supply hose 10 is connected toward the rear to a fixed blasting agent supply pipe 12. This pipe, in turn, ends in a clamping device in the traveling unit 50 and ends there with a suitable attachment component 13, to which a conventional blasting agent supply hose can be connected. The unit consisting of the blasting agent supply hose 10 and the blasting agent supply pipe 12 is supported movably inside the pipe-shaped support element 30.

The position in FIG. 1 corresponds to the operating position in which shot-peening is carried out on the inner wall of the pipe borehole 201 of the workpiece 200 by accelerating a suitable blasting agent, such as in particular small steel balls, via compressed air and exiting from the blasting nozzle head 20 to the side.

The support element 30 together with the flexible blasting agent supply hose 10 supported therein is moved toward the mouth of the workpiece 200 via a traveling unit. A funnel-shaped centering element 31 is provided to a secure and precise solid contact of the support element 30 to the end of the workpiece and to hold it during blasting.

The support element 30, in turn, is supported by a bearing element 40, which in the presented exemplary embodiment is also pipe-shaped. The bearing element 40 can be attached to a work chamber wall 300 such that the workpiece 200 can be treated shielded within the work chamber and exiting blasting agent can be caught. The end of the bearing element 40 protruding into the work chamber has a bellows 43 for sealing the gap between the support element 30 and the bearing element 40.

The assemblies 20, 30, 40 that are slideably guided in each other have different fixed stops 34, 35, 45, through which the travel paths that are possible in relation to each other are restricted. The fixed stop 35 at the end of the support element 30 is designed as an overhanging set-off at the support element 30 such that the support element 30 can be moved only in relation to the bearing element 40 until the fixed stop 35 rests on the bearing element 40.

Figure 3:
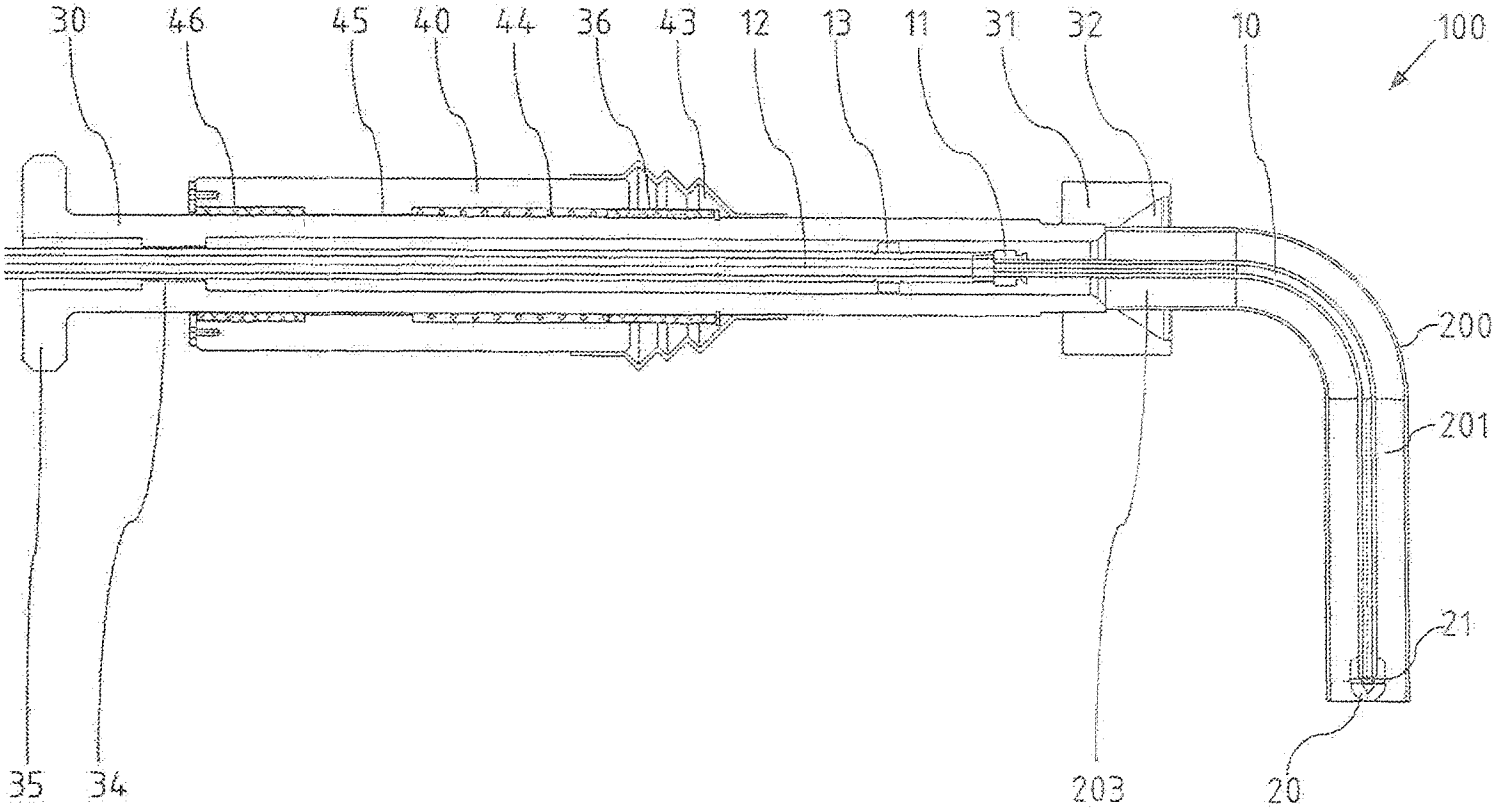
FIG. 3 is an enlarged sectional view of a blasting nozzle unit in the operating position.

FIG. 3 shows the blasting nozzle head 100) according to the invention and the workpiece 200 in the same position as in FIG. 1 in an enlarged presentation.

The bearing element 40 surrounds the other elements and has the bellows 43 for shielding at its side that faces the workpiece 200.

Figure 2:
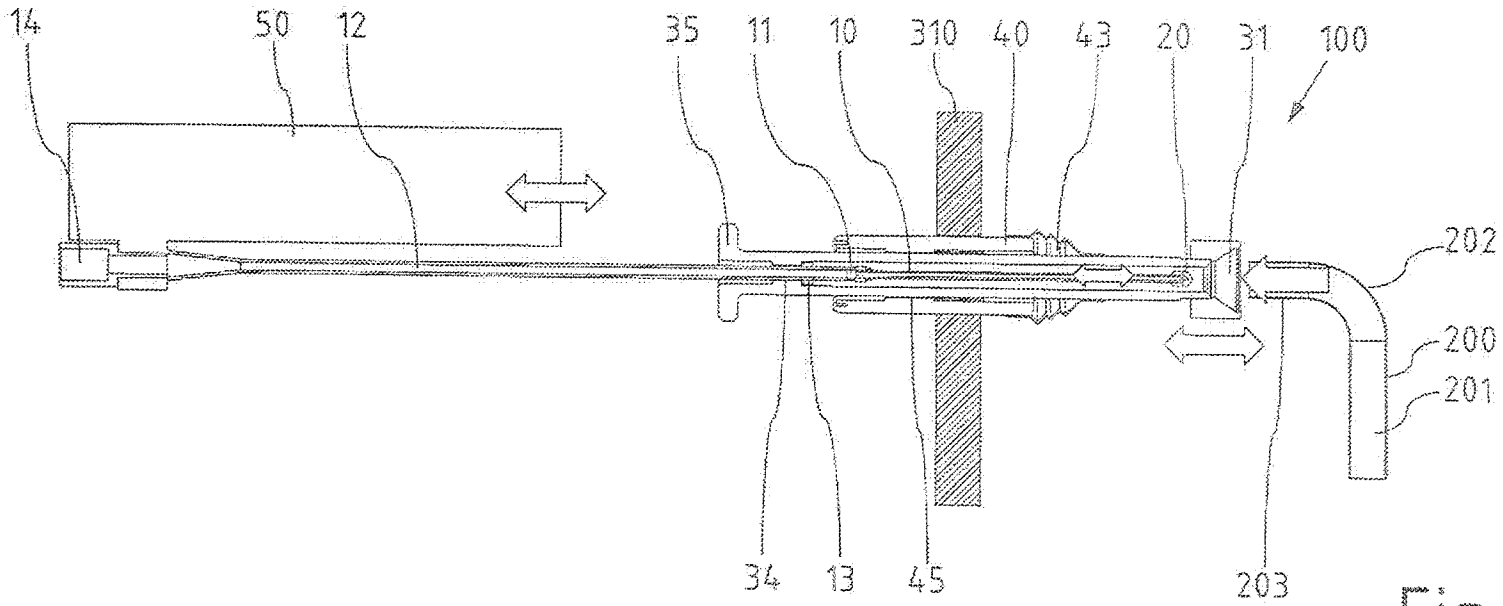
FIG. 2 shows a section of a blasting nozzle unit in the loading position.

The support element 30 is supported movably therein. Slide bearing elements 46, 47 are provided in the annular gap between the bearing element 40 and the support element 30 acting at the same time as a slide bearing and as a seal. The slide bearing element 46 shown left in FIG. 2 is defined by a washer screwed in at the end side in the bearing element 40. The other bearing element 36 is defined by a retaining ring at the outer circumference of the support element 30. At the same time, the bearing element 36 forms a fixed stop for a spring element 44, which in turn is defined by a fixed stop 45 at the inner circumference of the bearing element 40. The bearing element 36, the compressed spring element 44 and the fixed stop 45 prevent the support element 30 from being pulled out to the left from the bearing element 40.

In particular the elements mentioned last serve, however, as a feed unit to bring the support pipe 30 into a solid contact with the workpiece end 203 using the uncompressed spring element 44 that is designed as a compression spring and to hold it there while the blasting process runs. Thus no driven actuator is provided for the presented exemplary embodiment of the blasting nozzle unit 100 to carry out the relative movement between the bearing element 40 and the support element 30. Rather, the workpiece is moved toward the support element 30 via the spring element 44 as soon as the traveling unit 50 no longer exerts a retracting force. The support element 30 centers itself autonomously at its end using the centering element 31.

The path of the workpiece end prior to the start of the blasting treatment can be selected such that the workpiece 200 pushes the support element 30 slightly back relative to the bearing element 40 by a compression of the spring element 44. Due to the spring force, a largely constant pressing force can be maintained during the subsequent blasting process without any additional drive. After retracting the workpiece, the spring element 44 rebounds entirely and brings the support element 40 to its original position.

The outer circumference of the blasting nozzle head 12 is positioned at a distance from the inner wall of the workpiece. Thus, the outer circumference is smaller than the inner circumference of the workpiece borehole 201 in the workpiece 200 to be treated, namely so much smaller that an air gap remains in-between, which allows the support element 15 to be moved back and forth without the same being jammed inside the workpiece borehole 201.

Essential to the invention is that the blasting agent supply hose 10 with the blasting head has a small diameter such that it can be guided inside the workpiece borehole 201 without jamming and that it is guided by the support element at the beginning of blasting and then increasingly by the workpiece itself. The length of the blasting agent supply hose 10 is only selected such that it can be advanced to the end of the workpiece borehole 201, and shown in FIGS. 1 and 3. This effectively prevents buckling of the blasting agent supply hose 10.

The other regions of the length of the blasting agent supply are formed by the rigid blasting agent supply pipe 12, which is also guided in the support element 30 and protrudes freely from the end of the same. For centered guiding inside the support element 30, the support tube 12 has at least one annular centering element 13, which can also form a fixed stop element at the same time, which rests at the end of the intended retraction path on a fixed stop element 34 on the inside of the support element 30.

Regarding the centering element 31 at the support element 30, FIG. 3 shows that the same is designed such that the workpiece end 203 is located at the end of the funnel-shaped section in an indentation with a form and size that corresponds exactly to the outer circumference of the workpiece end 203. At the same time, the workpiece borehole transitions flush into the borehole in the centering element 30, wherein flush in the sense of the invention refers not only to the smooth transition at the same inner diameters but also a continuous, offset-free transition with conical transitions. The purpose is to avoid jumps in diameters, where the blasting nozzle head could be caught especially during the retraction movement.

The method for shot-peening an inner pipe wall of a curved workpiece 200 with a workpiece borehole 201 is explained below based on the figures.

Figure 4:
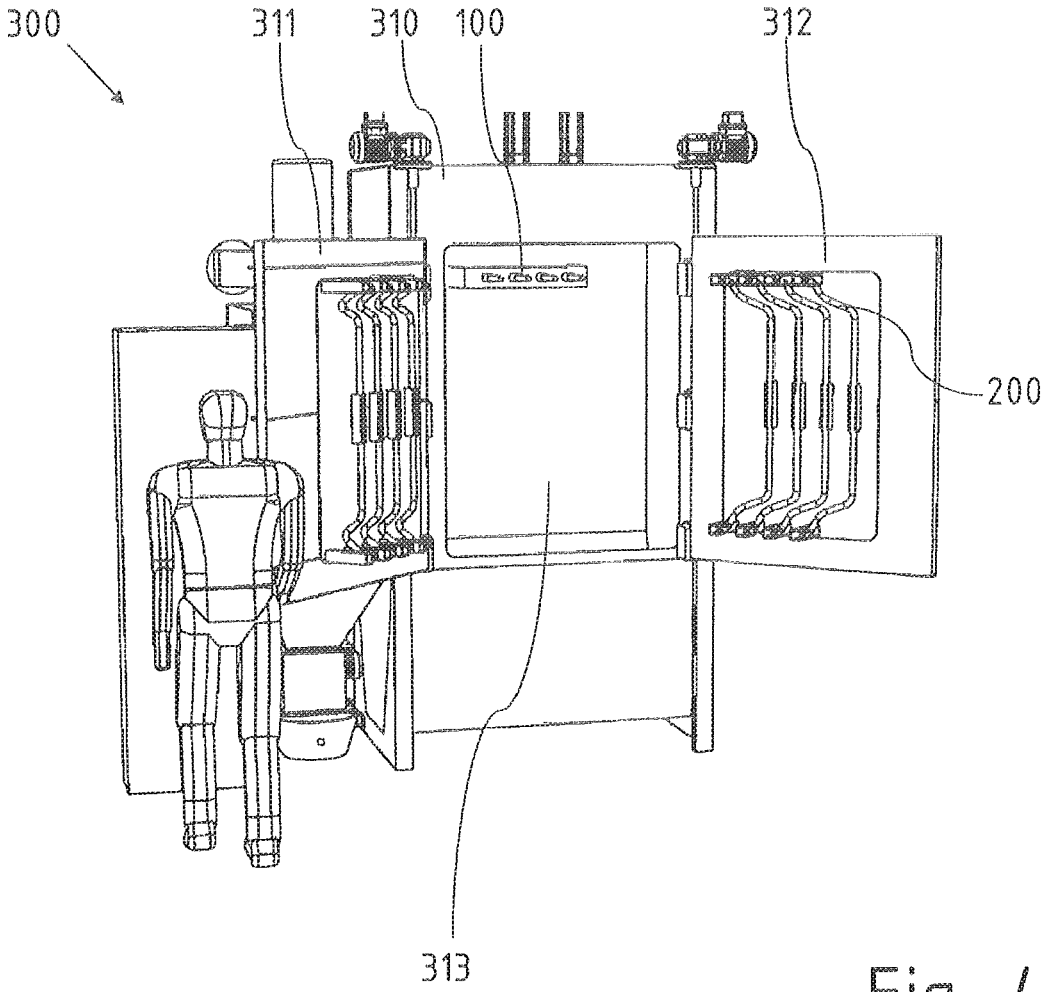
FIG. 4 is a perspective view of a work chamber in the loading position.

FIG. 4 shows parts of a work chamber system 300 with a work chamber 310 having a work chamber opening 313. An operating panel can be seen as well. For the purpose of clarity, not shown are known assemblies for supplying the blasting agent to the blasting nozzle unit as well as for extracting the blasting agent and the dust from the work chamber and for preparing the blasting agent for renewed introduction of the blasting agent into a closed circuit.

Pivoting doors 311, 312 are placed on both sides of the work chamber opening 313, wherein the work chamber opening is not closed jointly by the doors 311, 312, but alternately by the one or the other door 311, 312. Workpiece holders are placed on the inside of the door.

In a loading position, one workpiece each is placed therein. A blasting nozzle unit 100 is arranged inside the work chamber 310 and provides a common bearing element 40 for four support elements 30 with blasting agent supply hose 10 and blasting nozzle head 20. The ends of the support elements 30 point in the direction of the work chamber opening 313. The blasting agent supply hoses 10 are retracted as far relative to the support element 30 as shown in FIG. 2. In this situation, the blasting nozzle head 20 is located fully inside the support element 30. This is achieved through the movement of the travel unit 50.

Now the centering funnel is entirely free. As indicated by the block arrow on the right in FIG. 2, the workpiece end 203 is now moved toward the centering funnel 31. This occurs in the final phase of closing one of the doors 311, 312 at the work chamber 310.

Figure 5:
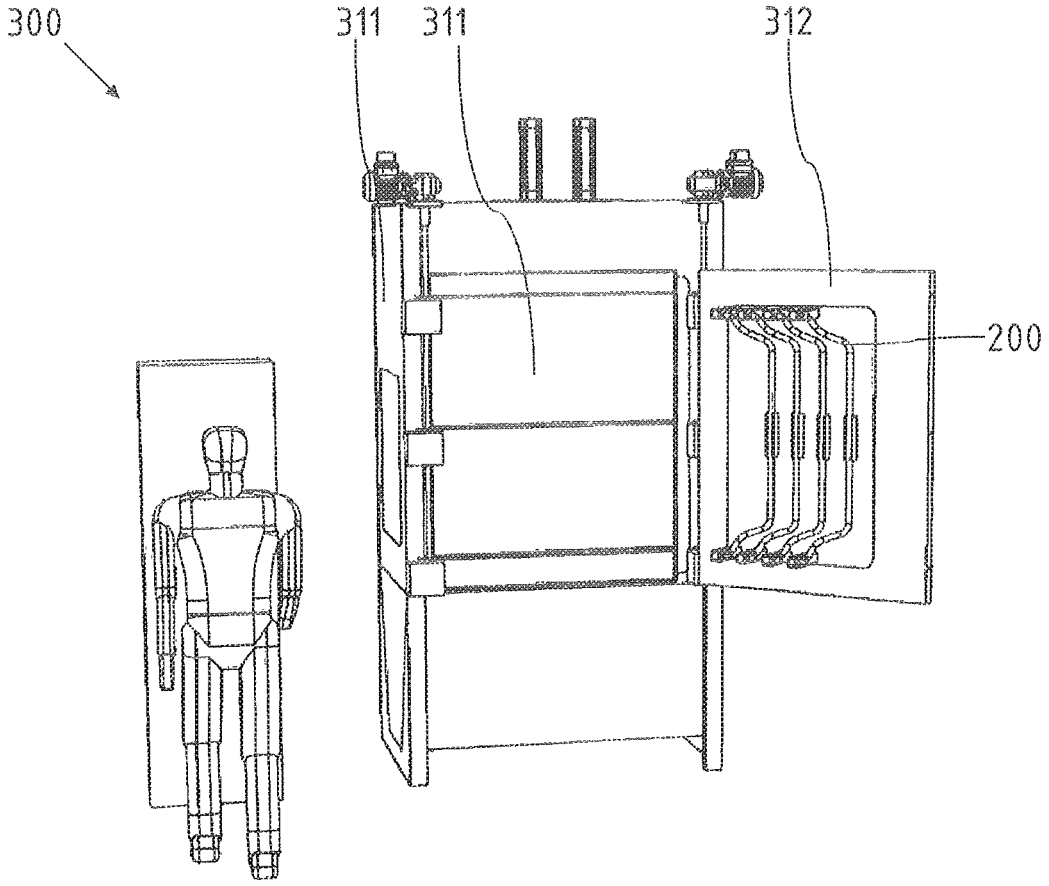
FIG. 5 is a perspective view of a work chamber in operating position.

The left door 311 is fully closed in FIG. 5. The right door, on the other hand, is free and can be populated in its workpiece holder. The position of the workpiece ends 203 relative to the blasting nozzle unit 100 in the inside of the work chamber is now shown in FIGS. 1 and 3: The workpiece end 203 rests in contact with the centering funnel element 31 at the support element 30. The support element 30 is pushed back relative to the bearing element 40, which can be seen in particular by the different positions of the collar 35 in FIG. 1 versus the previous position according to FIG. 2. The spring element 44 is slightly compressed.

The actual treatment process can now begin. To this end, the travel unit 50 is moved toward the bearing element 40 and the support element 30. The blasting agent supply pipe 12 connected therewith pushes the blasting agent supply hose 10 and the blasting nozzle head 20 forward. As soon as the workpiece end 203 is reached, the blasting agent is introduced and the treatment starts.

Blasting is initiated by conveying a blasting agent through the blasting agent supply hose 10 to the blasting nozzle head 12 using compressed air. Large amounts of the blasting agent are accelerated and impact the inner pipe wall. For example, air pressure of 5 to 6 bar is used to achieve a blasting agent flow of about 1 kg/min.

The blasting agent supply pipe 12 and the blasting agent supply hose 10 are then pushed further forward at a constant speed via the travel unit 50 until the blasting nozzle head 20 has reached the end position shown respectively in FIGS. 1 and 3 at the other end of the workpiece 200. Then starts the retraction of the blasting nozzle head 20. At this time, blasting agent can continue to be blasted to enhance the treatment effect.

The blasting agent supply is interrupted as soon as the blasting nozzle head 20 has returned to the workpiece end 203, and the blasting nozzle head 20 is retracted as far as shown in FIG. 2. By opening the door 311, the workpiece 200 moves away from the support pipe 30, which is returned to its original position through the spring 44.

By closing the other, right door 312, at which in the meantime new workpieces have been affixed, the described process can be repeated right away, while now the already treated workpieces can be removed from the open door.

There has thus been shown and described a novel method for shot peening a pipe inner wall of a curved workpiece having a workpiece bore, and a blasting nozzle unit and a blasting chamber system therefor, which fulfill all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A method for shot-peening an inner pipe wall of a curved workpiece having a workpiece borehole, said method comprising the following steps:

a) providing a blasting nozzle unit having a blasting nozzle head that is connected to a flexible blasting agent supply hose and has multiple nozzle openings distributed around the circumference and maintains with its outer circumference a distance from the inner wall of the workpiece to form an air gap, and b) blasting a blasting agent onto the inner wall of the workpiece by conveying a blasting agent through the blasting agent supply hose to the blasting nozzle head using compressed air;

c) guiding at least one end region of the blasting agent supply hose adjacent to the blasting nozzle head through a support element, wherein the support element and the workpiece end or the workpiece end are placed in contact with each other;

d) inserting the blasting agent supply hose with the blasting nozzle head is inserted into the workpiece borehole and pushing it forward along a blasting treatment path inside the workpiece borehole and thereafter retracting it again into the support element, while the blasting agent is being released through the nozzle openings during the forward movement and/or during the retraction movement; and e) retracting the support element from the workpiece end or the workpiece end is retracted from the support element;

wherein the blasting agent supply hose at its end that faces away from the blasting nozzle head is connected to a rigid blasting agent supply pipe, and wherein the unit comprising the blasting agent supply hose and blasting agent supply pipe is guided slidably inside the support element by a centering element positioned on the outside of the blasting agent supply pipe.

2. The method as in claim 1, wherein at least one of the blasting agent supply hose and the blasting agent supply pipe is retracted to a fixed stop in the support element.

3. The method as in claim 1, wherein the support element is guided in a stationary bearing element and placed in contact with the end of the workpiece by means of a spring element.

4. The method as in claim 1, wherein, when placing the support element in contact with the end of the workpiece, the borehole of the support element aligns with the workpiece borehole.

5. The method as in claim 1, further comprising using the blasting nozzle unit in a work chamber comprising two doors such that the work chamber opening can be closed alternatingly; and receiving the workpieces at the inside of the doors.

6. A blasting nozzle unit for carrying out a method for shot-peening an inner pipe wall of a curved workpiece having a workpiece borehole, said blasting nozzle unit comprising:

a flexible blasting agent supply hose;

a blasting nozzle head connected to the blasting agent supply hose and having multiple nozzle openings distributed-around a circumference of the blasting nozzle head;

a tubular support element upon which the blasting agent supply hose is supported; and a stationary tubular bearing element, upon which the support element is slideably guided by slide bearing elements;

wherein the blasting agent supply hose at its end that faces away from the blasting nozzle head is connected to a rigid blasting agent supply pipe; and wherein the unit comprising the blasting agent supply hose and the blasting agent supply pipe is supported slidably inside the tubular support element, and wherein at least one centering element is positioned on the outside of at least one of the blasting agent supply hose and the blasting agent supply pipe for centering the same in relation to the support element.

7. Blasting nozzle unit as in claim 6, wherein at least one centering element or one fixed stop element is positioned on the inside of the support element for centering and limiting the path of the blasting agent supply hose and the blasting agent supply pipe guided on the inside.

8. The blasting nozzle unit as in claim 6, wherein a stop for a spring element is formed in the bearing element and said spring element is additionally directly or indirectly supported by the fixed stop at the support element.

9. The blasting nozzle unit as in claim 6, wherein the support element is supported in the bearing element via two slide bearing elements.

10. The blasting nozzle unit as in claim 6, wherein the support element at its one mouth is provided with a centering element.

11. The blasting nozzle unit as in claim 10, further comprising a traveling unit for moving at least one of the blasting agent supply hose that points away from the blasting nozzle head and the blasting agent supply pipe adjacent thereto, respectively.

* * * * *